US007494377B2

(12) United States Patent
Yohn et al.

(10) Patent No.: US 7,494,377 B2
(45) **Date of Patent: *Feb. 24, 2009**

(54) ELECTRICAL CONNECTOR

(75) Inventors: Brent David Yohn, Newport, PA (US); William Henry Bernhart, Monroe, WA (US); Richard Paul Walter, Elizabethtown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 23 days.

This patent is subject to a terminal disclaimer.

(21) Appl. No.: 11/186,500

(22) Filed: Jul. 21, 2005

(65) Prior Publication Data

US 2006/0035514 A1 Feb. 16, 2006

Related U.S. Application Data

(63) Continuation-in-part of application No. 10/917,939, filed on Aug. 13, 2004, now Pat. No. 7,044,789.

(51) Int. Cl.
*H01R 13/40* (2006.01)

(52) U.S. Cl. ..... 439/599; 439/598; 439/589; 439/695; 439/686

(58) Field of Classification Search ..... 439/460, 439/599, 598, 695, 686, 589
See application file for complete search history.

(56) References Cited

U.S. PATENT DOCUMENTS 2,404,682 A 7/1946 Baker
3,611,273 A 10/1971 Alibert
4,214,802 A 7/1980 Otani et al.
5,567,174 A 10/1996 Ericson, Jr. et al.
5,755,589 A 5/1998 Koch
6,616,482 B2 9/2003 De La Cruz et al.
6,669,502 B1 12/2003 Bernhart et al.
7,044,789 B2 * 5/2006 Yohn et al. ..... 439/599

FOREIGN PATENT DOCUMENTS

DE 297 19 217 U1 2/1998
EP 1 193 812 A1 4/2002

OTHER PUBLICATIONS

PCT Search Report for counterpart case, PCT/US2006/028007.

* cited by examiner

*Primary Examiner*—Truc T Nguyen
*Assistant Examiner*—Xuong M Chung-Trans

(57) ABSTRACT

An electrical connector includes a plurality of contacts, and an outer shell having a cavity formed therein. The cavity extends between a loading end and a mating end of the outer shell, and the mating end is configured to join with a mating connector. A front dielectric member includes a base portion and an appendage extending from a rear end of the base portion. The base portion and the appendage have contact passages receiving the contacts. A rear dielectric member includes a hollow interior and contact passages extending between front and rear ends of the rear dielectric member and defining the hollow interior. The front end of the rear dielectric member contacts the rear end of the front dielectric member such that the appendage is positioned within the hollow interior of the rear dielectric member. The contact passages of the appendage and the rear dielectric member cooperate to surround the contacts.

20 Claims, 9 Drawing Sheets

ELECTRICAL CONNECTOR

CROSS REFERENCE TO RELATED APPLICATIONS

This application is a continuation-in-part application of U.S. patent application Ser. No. 10/917,939 filed Aug. 13, 2004 now U.S. Pat. No. 7,044,789, which is hereby incorporated by reference in its entirety.

BACKGROUND OF THE INVENTION

This invention relates generally to electrical connectors, and more particularly, to an axial connector for positioning and retaining wires and contacts in a fixed position.

Connectors exist today that are mountable to the ends of a coaxial cable. In certain applications, the cables carry one or more differential signals. For instance, quad cables are used for conveying high-speed data communications. The quad cables include one pair of transmit lines and one pair of receive lines, all of which are twisted in a helix to maintain a desired orientation with respect to one another. When a connector is attached to a quad cable, it is preferable to maintain the transmit and receive lines in a fixed geometry. The transmit and receive lines are connected to transmit and receive contacts which are located in a particular relation to one another within the connector. In the event that the spacing between, or overall geometry of, the transmit and receive lines and/or contacts is disturbed from a preferred configuration, particular receive and/or transmit lines begin to interact with one another in a detrimental manner. For example, such detrimental electromagnetic interaction may cause degradation in the signal-to-noise ratio, impedance and the like, such as cross talk and/or electromagnetic interference.

One conventional quad connector includes a tubular shell having connected to lines of the quad cable. The two-piece dielectric includes a rear dielectric segment stacked end-to-end with a lead guide dielectric segment, where each segment is molded separately. The lead guide segment includes a group of holes therethrough arranged in a pattern in which the contacts are held. Lead portions of each contact are loaded through the back end of the guide segment. Once loaded into the guide segment, the contacts have rear portions extending from the back end of the guide segment.

The rear dielectric segment of the two-piece dielectric is side loaded onto the rear portions of the contacts that extend from the guide segment. The rear dielectric segment is tubular in shape and includes slots cut in the side thereof, with the slots being separated by an insulated interior wall. Rear portions of the contacts are side loaded into the slots in the split section. The slots extend along the length of the rear dielectric segment. The rear portions of the contacts are formed with a ribbed or raised peripheral segment surrounding the main body of each contact. The main body of each contact is formed with a first diameter, while the raised portion is formed with a larger second diameter. The slots cut in the split dielectric segment are notched to define a stepwise slot width having ledges dimensioned to interlock with the raised portion of each contact.

The interlocking relation formed between the slots and the raised portions of the contacts resists longitudinal movement of the contacts along the length of the rear split dielectric segment. The split dielectric segment abuts against the rear end of the guide dielectric segment, thereby preventing longitudinal movement of the split dielectric segment within the connector shell, which in turn prevents movement of the contacts along the length of the connector.

However, previously proposed connector designs have met with limited success. The connectors have very small overall size and are assembled in large quantities. The connectors have been unable to satisfactorily maintain the contacts in a desired geometry or position during assembly of the connector because the two pieces act independently with respect to one another. Moreover, the contacts of the connectors remain exposed to the outer shell of the connector when the dielectrics are loaded into the outer shell leading to possible failure of the connector.

A need remains for an improved coaxial connector that may be easily and reliably manufactured and assembled, and that provides insulation to the contacts of the connector.

BRIEF DESCRIPTION OF THE INVENTION

In accordance with an embodiment of the present invention, an electrical connector is provided that includes a plurality of contacts and an outer shell having a cavity formed therein. The cavity extends between a loading end and a mating end of the outer shell, and the mating end is configured to join with a mating connector. A front dielectric member includes a base portion and an appendage extending from a rear end of the base portion. The base portion and the appendage have contact passages receiving the contacts. A rear dielectric member includes a hollow interior and contact passages extending between front and rear ends of the rear dielectric member and defining the hollow interior. The front end of the rear dielectric member contacts the rear end of the front dielectric member such that the appendage is positioned within the hollow interior of the rear dielectric member. The contact passages of the appendage and the rear dielectric member cooperate to surround the contacts.

Certain embodiments of the present invention may also include contact passages of the appendage that extend along a radially inner surface of the contacts and contact passages of the rear dielectric member that extend along a radially outer surface of the contacts. Optionally, the contact passages of the appendage may be defined by radiused surfaces and have an open side, and contact passages of the rear dielectric member may be defined by radiused surfaces and have an open side. Edges of the radiused surfaces of the appendage and the rear dielectric member may engage one another. The front dielectric member may include a sleeve extending from the base portion, and the front end of the rear dielectric member may be inserted at least partially into said insulating sleeve. Optionally, the contacts may include a ledge and one of the front and rear dielectric members may include a shoulder such that the contacts are received in the front and rear dielectric members until the ledge engages the shoulder.

Certain embodiments of the present invention may also include front and rear dielectric members having chamfered abutment surfaces which overlap one another. Optionally, the front and rear dielectric members may include keying features engaging one another for aligning the dielectric members with one another. The keying features may include a pin or a pocket. Optionally, the outer shell may include a keying feature configured to engage a keying feature of one of the front and rear dielectric members for aligning the dielectric members within the outer shell.

In accordance with another embodiment of the present invention, an electrical connector assembly is provided including a cable with contacts secured to cable connectors, and an outer shell with a cavity therein. The cavity extends through the shell. A front dielectric member has a base portion and an appendage extending from a rear end of the base portion. The base portion and the appendage have contact passages configured to receive the contacts. The contact passages of the appendage are configured to receive the contacts such that at least a portion of the contacts are exposed laterally through open sides of the contact passages. A rear dielectric member has contact passages extending between front and rear ends of the rear dielectric member. The contact passages of the rear dielectric member are configured to receive the contacts such that at least a portion of the contacts are exposed laterally through open sides of the contact passages. The appendage is positioned within the rear dielectric member such that the contact passages of the appendage and the rear dielectric member cooperate to surround the contacts.

DETAILED DESCRIPTION OF THE INVENTION

Figure 1:
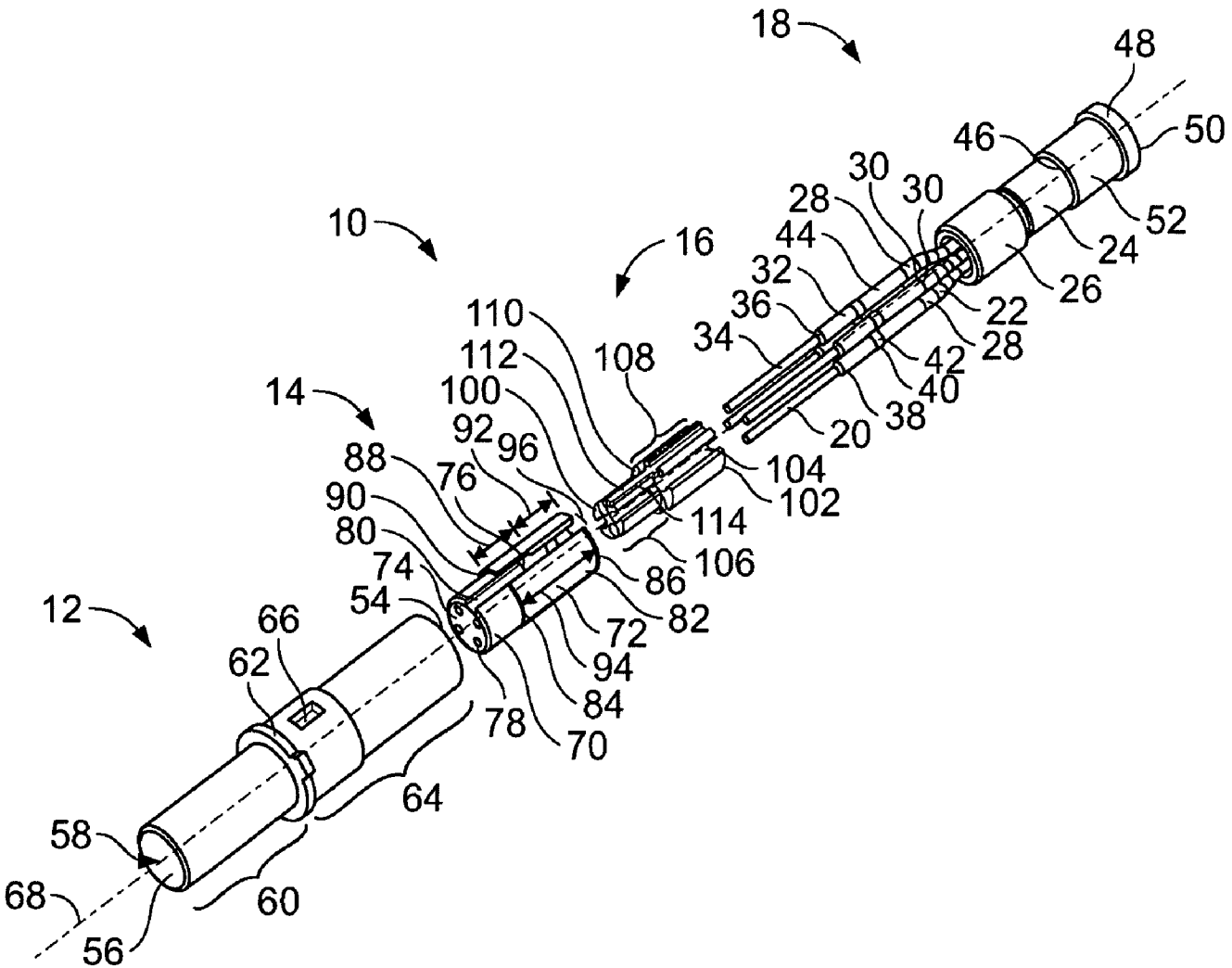
FIG. 1 illustrates an exploded isometric view of a connector assembly formed in accordance with an embodiment of the present invention.

FIG. 1 illustrates an exploded isometric view of a connector assembly 10 formed in accordance with an embodiment of the present invention. The connector assembly 10 includes an outer shell 12 that receives therein a front dielectric member 14, a rear dielectric member 16, and a ferrule 18. A plurality of contacts 20 are mounted to corresponding signal wires 22 and inserted into the dielectric members 14 and 16. The signal wires 22 are held within a cable 24. An outer braid 26 is folded back over the cable 24 and the ferrule 18 to expose the signal wires 22 (each of which is individually insulated).

In certain applications, the signal wires 22 may be grouped into differential pairs and arranged in a particular geometry, such as a quadrature arrangement with a transmit pair 28 and a receive pair 30 as in the example of FIG. 1. Optionally, the signal wires 22 of each differential pair is positioned diagonally with respect to one another. Alternatively, the number of signal wires 22 may be varied and the geometry thereof may be changed. By way of example only, the number of signal wires 22 may be varied to include two wires, three wires, eight wires and the like.

The contacts 20 are each formed with a body section 32 having a pin 34 extending from a lead end 36 thereof. Each body section 32 has a larger diameter than the diameter of the corresponding pin 34 in order to define a flared section 38 therebetween. The body section 32 includes a raised surface defined by a front facing shoulder 40 and a rear facing shoulder 42. The flared section 38 and the shoulders 40 and 42 may be sloped or step-wise. Each body section 32 further includes a wire barrel 44 formed thereon and extending opposite to the pin 34. The wire barrel 44 is hollow and configured to receive the conductors of a corresponding signal wire 22. The wire barrels 44 may be affixed to corresponding signal wires 22 in a variety of manners, such as soldering, crimping and the like. As a further option, the overall configuration and shape of the contacts 20 may be varied and need not include the pins 34. Instead, the contacts 20 may include blade portions, or any other well-known contact shape.

The ferrule 18 includes an opening 46 extending therethrough and a rim 48 at a rear end 50 of the ferrule 18. The ferrule 18 is inserted over the contacts 20 until resting upon the cable 24. The ferrule 18 includes an exterior wall 52 that is dimensioned to be received within the braid 26 and to sandwich the braid 26 between the ferrule 18 and the outer shell 12 with the rim 48 proximate a loading end 54 of the outer shell 12.

The outer shell 12 is generally tubular in shape and is formed with a mating end 56 configured to be joined with a corresponding mating connector assembly, such as a socket connector assembly (not shown). The outer shell 12 includes a cavity 58 extending therethrough between the loading and mating ends 54 and 56. The outer shell 12 includes a lead portion 60 dimensioned to be received within the mating connector assembly. A rim 62 is provided at an interface between the lead portion 60 and a body portion 64. The body portion 64 includes a lug 66 formed along the length of the body portion 64, thereby defining a keying feature that projects into the cavity 58. The lug 66 extends in a direction parallel to a longitudinal axis 68 of the connector assembly 10 (also referred to as the center line of the outer shell 12).

The front dielectric member 14 may be a unitary structure formed from a single piece of insulative material. The front dielectric member 14 includes a base portion 70 and an insulating sleeve 72. Optionally, the base portion 70 may be formed integrally with the insulating sleeve 72. The base portion 70 extends between front and rear ends 74 and 76 and is oriented along the longitudinal axis 68. The base portion 70 is sized to be positioned within the outer shell 12. A plurality of contact passages 78 are formed within the base portion 70 of the front dielectric member 14 and extend between the front and rear ends 74 and 76 of the base portion 70. The contact passages 78 are formed in a predefined geometry relative to the longitudinal axis 68 of the connector assembly 10 based on the particular application and geometry of the cable 24. A keying notch 80 is formed in the exterior of the base portion 70 and extends rearward from the front end 74. The keying notch 80 is shaped and positioned to interface with the lug 66 projecting into the cavity 58 of the outer shell 12.

The insulating sleeve 72 has a generally tubular shape and includes a body 82 extending between a front end 84 and a rear end 86. A portion of the insulating sleeve 72 extends circumferentially around the base portion 70 for a distance 88. Specifically, the insulating sleeve 72 has a greater diameter than the diameter of the base portion 70 such that a shoulder 90 is defined between the base portion 70 and the insulating sleeve 72 at the front end 84 of the insulating sleeve 72. The shoulder 90 locates the dielectric members 14 and 16 at a predetermined depth within the outer shell 12 from the mating end 56 along the longitudinal axis 68. Moreover, the insulating sleeve 72 extends rearward from the rear end 76 of the base portion 70 for a distance 92, thus giving the insulating sleeve 72 a length 94. In one embodiment, a gap 96 extends through the body 82 between the front and rear ends 84 and 86 of the insulating sleeve 72. Alternatively, the gap 96 extends only partially between the front and rear ends 84 and 86. Optionally, the gap 96 is substantially aligned with the keying notch 80 in the exterior of the base portion 70 such that the gap 96 is aligned with the lug 66 in the outer shell 12.

The rear dielectric member 16 may be a unitary structure formed from a single piece of insulative material. The rear dielectric member 16 is discrete from the front dielectric member 14. The rear dielectric member 16 includes front and rear ends 100 and 102 oriented along the longitudinal axis 68. A plurality of contact passages 104 are formed within the rear dielectric member 16 and extend between the front and rear ends 100 and 102. Each contact passage 104 includes an open or exposed side, such that, when the contacts 20 are inserted into the contact passages 104, a lateral portion of the contacts 20 are exposed to the environment surrounding the rear dielectric member 16. The rear dielectric member 16 is designed as such for ease of manufacture and to reduce the size and weight of the overall connector assembly 10. The contact passages 104 are formed in a predefined geometry relative to the longitudinal axis 68 of the connector assembly 10 based on the particular application and geometry of the cable 24. Moreover, the contact passages 104 of the rear dielectric member 16 are substantially aligned with the contact passages 78 of the front dielectric member 14 when the connector assembly 10 is assembled.

The rear dielectric member 16 includes a lead section 106 having a uniform exterior diameter that is smaller than a uniform exterior diameter of the back section 108. The lead section 106 extends into the insulating sleeve 72 within the front dielectric member 14 when the connector assembly 10 is assembled. Optionally, the exterior diameter of the lead section 106 may be substantially similar to the interior diameter of the insulating sleeve 72 such that the outer surface of the lead section 106 and the inner surface of the insulating sleeve 72 contact one another. In one embodiment, the lead section 106 and/or the insulating sleeve may be tapered. A rim 110 is formed on the rear dielectric member 16 at the interface between the lead and back sections 106 and 108. The rim 110 locates the rear dielectric member 16 with respect to the front dielectric member 14 along the longitudinal axis 68. Specifically, when assembled, the rim 110 abuts against the rear end 86 of the insulating sleeve 72, and the front end 100 of the rear dielectric member 16 abuts against the rear end 76 of the base portion 70.

Additionally, the rear dielectric member 16 includes a keying feature 112 extending along an exterior 114 of the rear dielectric member 16 from the front end 100 toward the rim 110. The keying feature 112 is sized and shaped to interface with the gap 96 extending along the insulating sleeve 72. Optionally, the keying feature 112 may include chamfered edges to more easily insert the rear dielectric member 16 into the front dielectric member 14. The keying feature 112 limits rotation of the rear dielectric member 16 with respect to the front dielectric member 14.

During assembly, the contacts 20 are inserted through the slot defined by the exposed side of the contact passage 104. Alternatively, the contacts 20 may be partially inserted into the contact passages 104 of the rear dielectric member 16. Optionally, the contacts 20 may be loaded into the contact passages 104 from the rear end 102 of the rear dielectric member 16. The rear dielectric member 16 aligns the contacts 20 with the contact passages 78 in the front dielectric member 14 prior to coupling the dielectric members 14 and 16 together. To couple the dielectric members 14 and 16 together, the keying feature 112 is visually aligned with the gap 96 in the insulating sleeve 72, and then the lead section 106 of the rear dielectric member 16 is inserted into the insulating sleeve 72 until the front end 100 of the rear dielectric member 16 abuts against the rear end 76 of the base portion 70 and the rim 110 abuts against the insulating sleeve 72. The dielectric members 14 and 16 and/or the outer shell 12 may be loaded onto the contacts 20 to the loaded position prior to inserting the dielectric members 14 and 16 into the outer shell 12. To insert the dielectric members 14 and 16 into the outer shell 12, the keying notch 80 of the front dielectric member 14 is visually aligned with the lug 66 of the outer shell 12, and the dielectric members 14 and 16 are inserted into the loading end 54 of the outer shell 12 as a single unit. Once loaded, the connector assembly 10 is assembled and the connector assembly 10 may be secured by a crimping process, such as, for example, a hex-crimp process or an O-crimp process.

Figure 2:
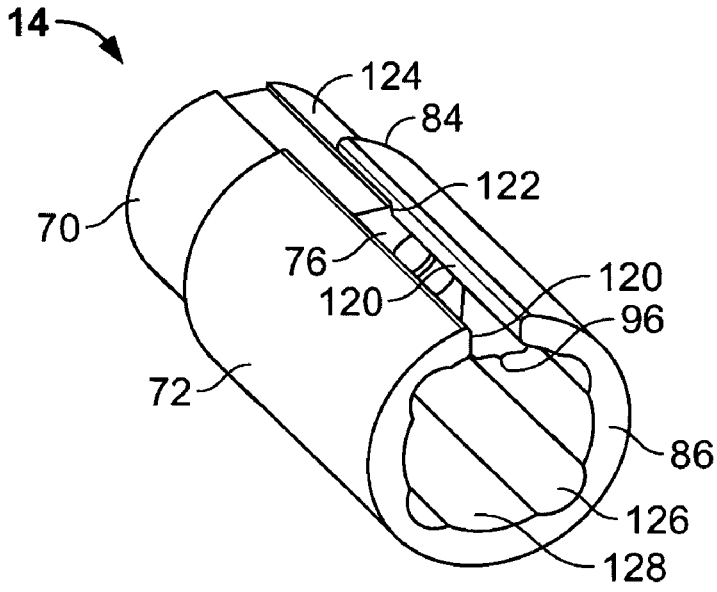
FIG. 2 illustrates an end isometric view of a front dielectric member formed in accordance with an embodiment of the present invention.

FIG. 2 illustrates an end isometric view of the front dielectric member 14 with the rear end 76 visible. In the example of FIG. 2, the insulating sleeve 72 defines a cover for the lead section 106 of the rear dielectric member 16 (FIG. 1). The gap 96 extends from the front end 84 to the rear end 86 of the insulating sleeve 72, and defines a pair of sidewalls 120. The sidewalls 120 have a notch portion 122 extending around the rear end 76 of the base portion 70 such that a portion of the sidewalls 120 extend above and a portion of the sidewalls 120 extend below an outer perimeter 124 of the base portion 70. When assembled, the sidewalls 120 contact both the keying feature 112 of the rear dielectric member 16 and the lug 66 of the outer shell 12 (FIG. 1). Optionally, the sidewalls 120 may include chamfered edges.

A series of radiused surfaces 126 extend along an inner surface 128 of the insulating sleeve 72 to the rear end 76 of the base portion 70. When assembled, the radiused surfaces 126, in combination with the corresponding contact passage 104 of the rear dielectric member 16, define an insulated contact passage for the contacts 20. Accordingly, the contacts 20 extending through the dielectric members 14 and 16 are insulated from the outer shell 12 by the insulating sleeve 72.

Figure 3:
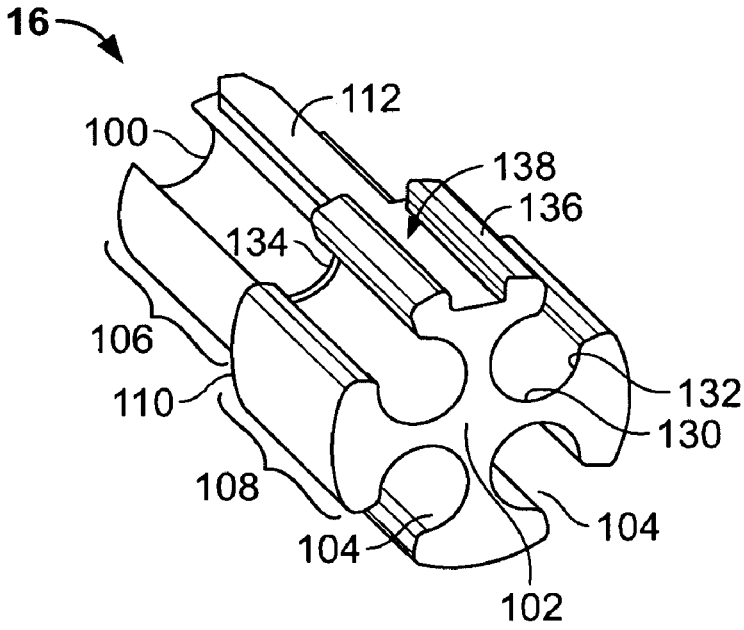
FIG. 3 illustrates an end isometric view of a rear dielectric member formed in accordance with an embodiment of the present invention.

FIG. 3 illustrates an end isometric view of the rear dielectric member 16 with the rear end 102 visible. In the example of FIG. 3, each contact passage 104 is defined by an insulated interior wall 130 having a radiused surface 132 that extends partially around the contact passage 104 such that at least a portion of each contact passage 104 is exposed to the environment around the rear dielectric member 16. Alternatively, the contact passages 104 may be entirely surrounded by insulating material. The contact passages 104 extend between the front and rear ends 100 and 102 of the rear dielectric member 16 and may have a non-uniform diameter such that a lip 134 is positioned between the front and rear ends 100 and 102. In the example of FIG. 3, the lip 134 is positioned proximate to the rim 110 such that the lip 134 is between the lead and back sections 106 and 108. Once assembled, the lips 134 support a portion of the contacts 20 loaded into the contact passages 104.

As illustrated in FIG. 3, the keying feature 112 extends toward the front end 100 of the rear dielectric member 16 from the rim 110. Moreover, a portion of an outer perimeter 136 of the back section 108 includes a recess 138. Optionally, the recess 138 may be aligned with the keying feature 112 extending along the lead section 106. As such, the recess 138 is aligned with the gap 96 (FIG. 1) when the dielectric members 14 and 16 are assembled. The recess 138 may receive a keying feature, such as the lug 66, when the dielectric members 14 and 16 are loaded into the outer shell 12.

Figure 4:
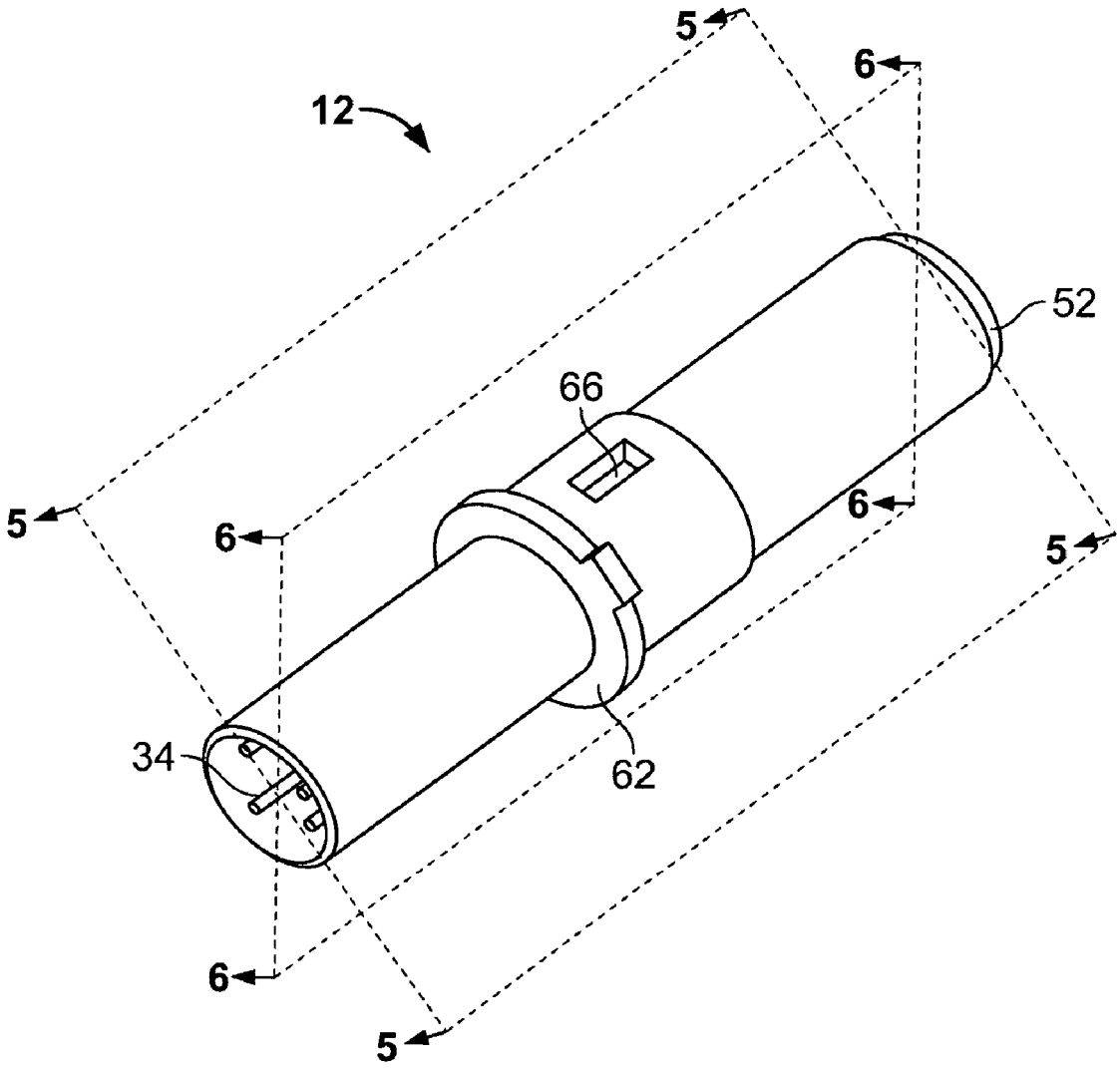
FIG. 4 illustrates an isometric view of the connector assembly shown in FIG. 1 in an assembled state.
Figure 5:
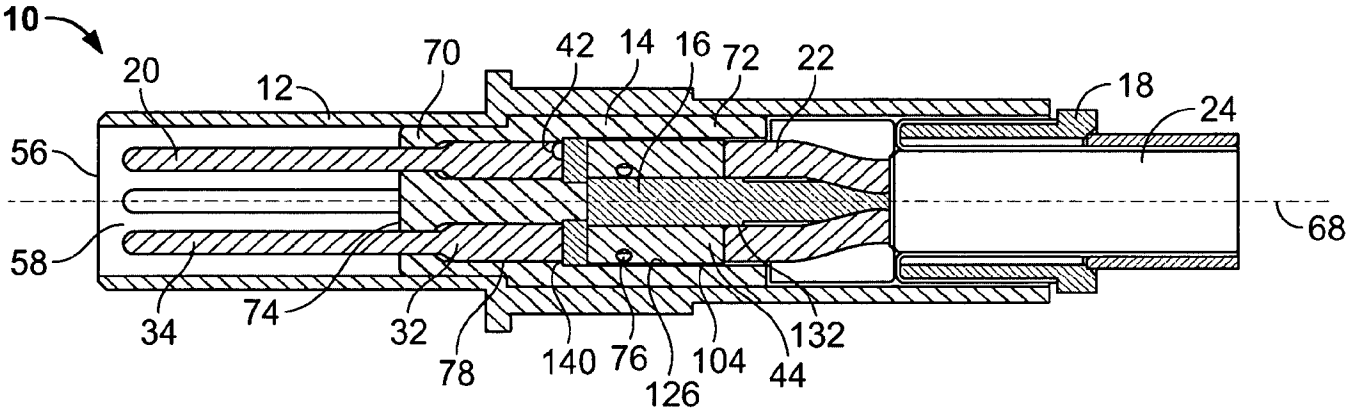
FIG. 5 illustrates a side sectional view of the connector assembly shown in FIG. 1 and taken along Line 5—5 in FIG. 4.
Figure 6:
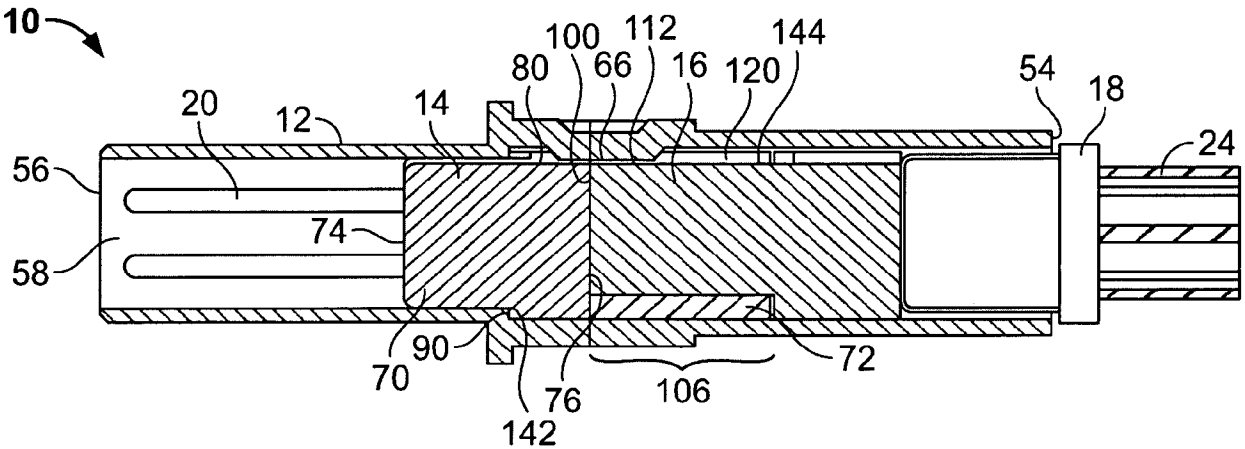
FIG. 6 illustrates another side sectional view of the connector assembly shown in FIG. 1 and taken along Line 6—6 in FIG. 4.

FIG. 4 illustrates an isometric view of connector assembly 10 in an assembled state. FIG. 5 illustrates a side sectional view of the connector assembly 10 taken along line 5—5 in FIG. 4. FIG. 6 illustrates a side sectional view of the connector assembly 10 taken along line 6—6 in FIG. 4. As illustrated in detail in FIG. 5, the contacts 20, the signal wires 22, and the cable 24 are loaded into the front dielectric member 14, the rear dielectric member 16, and the ferrule 18 in a predetermined arrangement. As illustrated in detail in FIG. 5, the dielectric members 14 and 16 and the ferrule 18 are loaded into the outer shell 12 in a predetermined arrangement.

The contact passages 78 and 104 extending through the front and rear dielectric members 14 and 16, respectively, are formed with a stepwise diameter to define a shelf 140 to properly position the contacts 20 within the connector assembly 10. Specifically, the pins 34 of each contact 20 extend through the front end 74 of the base portion 70 and are positioned in the cavity 58 proximate to the mating end 56 of the outer shell 12. The body sections 32 extend through the base portion 70 and the forward facing shoulder 40 of the body section 32 is positioned proximate the rear end 76 of the base portion 70. Additionally, the rear facing shoulder 42 of the body section is positioned proximate the lip 134 of the rear dielectric member 16. The forward and rear facing shoulders 40 and 42, respectively, define stops for the contacts 20 to resist movement of the contacts 20 along the longitudinal axis 68 of the connector assembly 10 beyond a predetermined amount. The wire barrels 44 of each contact 20 extend through the dielectric members 14 and 16 such that the wire barrels 44 are surrounded by both the radiused surfaces 132 of the rear dielectric member 16 and the radiused surfaces 126 of the insulating sleeve 72. As such, the wire barrels 44 are surrounded by insulating material. Because the metal contacts 20 are surrounded by insulating material, the risk of failure is reduced, the signal integrity is maintained, and the voltage capacity of the connector assembly 10 is increased. The signal wires 22 extend from the cable 24 to the wire barrels 44 through the rear dielectric member 16, and the ferrule 18 surrounds the cable 24.

FIG. 6 illustrates the dielectric members 14 and 16 and the ferrule 18 fully loaded into the outer shell 12 in a predetermined arrangement. The front dielectric member 14 is positioned within the cavity 58 proximate the mating end 56 of the outer shell 12. The front dielectric member 14 is positioned adjacent a ledge 142 formed in the inner surface of the outer shell 12. Specifically, the outer shell 12 is formed with a stepwise diameter to define the ledge 142. The ledge 142 locates the dielectric members 14 and 16 at a predetermined depth within the outer shell 12 from the mating end 56 along the longitudinal axis 68. The ledge 142 interacts with the shoulder 90 of the front dielectric member 14 to stop further insertion of the dielectric members 14 and 16 within the outer shell 12. The rear dielectric member 16 is positioned adjacent the front dielectric member 14. Specifically, the front end 100 of the rear dielectric member 16 abuts against the rear end 76 of the base portion 70. Additionally, the lead section 106 of the rear dielectric member 16 is surrounded be the insulating sleeve 72. The sidewalls 120 of the insulating sleeve 72 extend above and below an outer perimeter 144 of the lead section 106 to retain the rear dielectric member 16 therebetween. The ferrule 18 is positioned proximate the loading end 54 of the outer shell 12 and the cable 24 extends from the rear end 50 of the ferrule 18. Additionally, movement of the components is limited after crimping of the connector assembly 10.

As illustrated in FIG. 6, the lug 66 extends into the cavity 58 to a predetermined depth. The lug 66 aligns the dielectric members 14 and 16 within the outer shell 12. Specifically, the keying notch 80 and/or the keying feature 112 of the dielectric members 14 and 16 are aligned with the lug 66 prior to inserting the dielectric members 14 and 16 into the outer shell 12. As such, the dielectric members 14 and 16 have a predetermined orientation within the outer shell 12 so that the connector assembly 10 can be mated with the corresponding mating connector assembly. Optionally, the lug 66 may extend over both the front and rear dielectric members 14 and 16. The lug 66 limits rotational movement of the dielectric members 14 and 16 within the outer shell 12. Moreover, the insulating sleeve 72 and the back section 108 of the rear dielectric member 16 are substantially flush with the inner surface of the outer shell 12. As such, movement of the dielectric members 14 and 16 in a direction perpendicular to the longitudinal axis 68 is limited.

The above-described embodiments provide a cost effective and reliable means for developing an connector assembly 10. Specifically, the connector assembly 10 includes a plurality of contacts 20 that are configured to be retained and aligned by a pair of dielectric members 14 and 16 within an outer shell 12. The front dielectric member 14 includes an insulating sleeve 72 that extends over a portion of the rear dielectric member 16 and covers the contacts 20 disposed therein, thus insulating the contacts 20 from the metallic body of the outer shell 12. The dielectric members 14 and 16 include keying features that align the dielectric members 14 and 16 with each other and with the outer shell 12 during assembly. Accordingly, the assembly time and complexity, and thereby the overall cost, of the connector assembly 10 are reduced.

Exemplary embodiments of a connector assembly 10 are described above in detail. The connector assembly 10 is not limited to the specific embodiments described herein, but rather, components of each connector assembly 10 may be utilized independently and separately from other components described herein. For example, each connector assembly 10 component can also be used in combination with other connector assembly 10 components.

Figure 7:
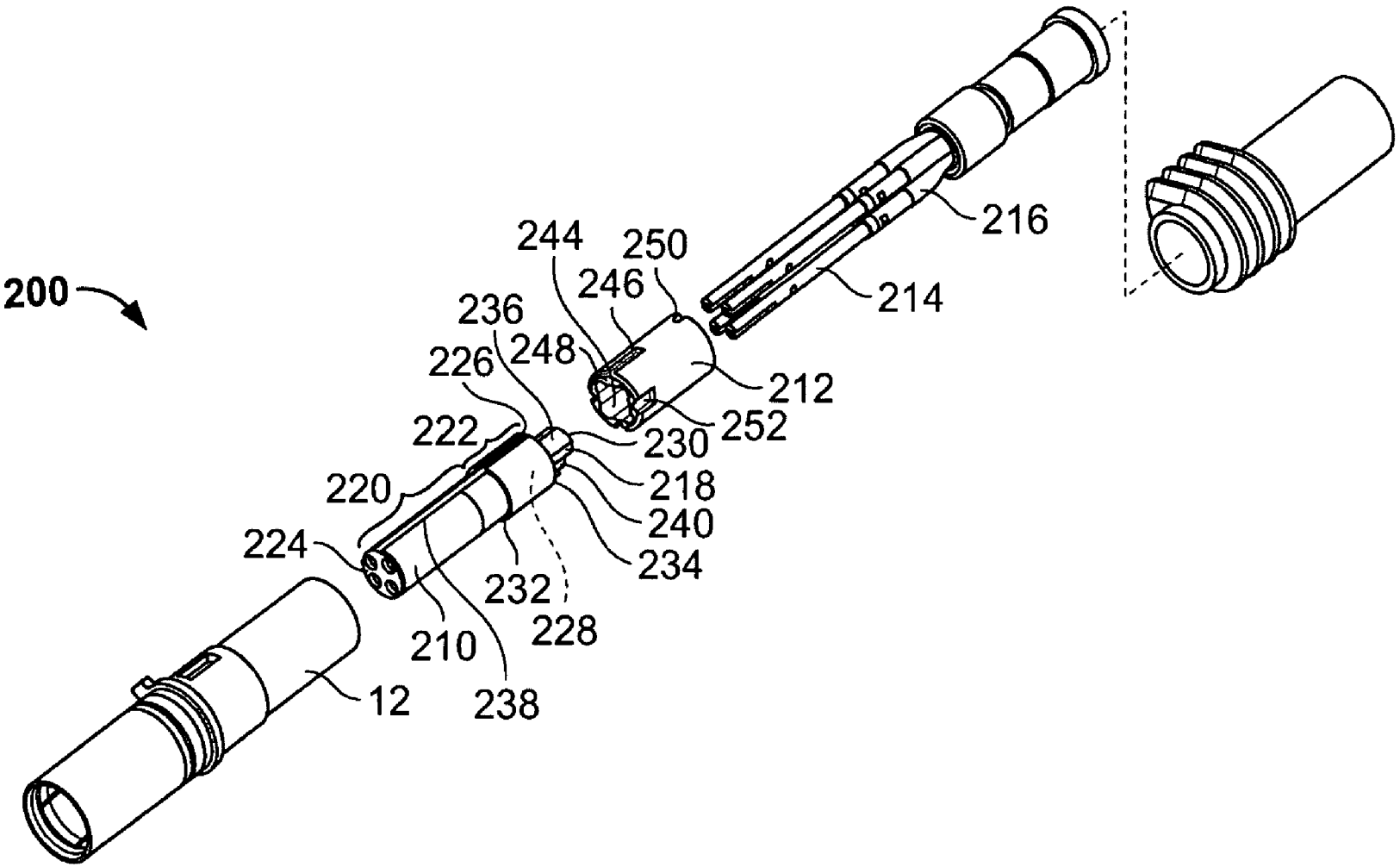
FIG. 7 illustrates an exploded isometric view of a socket connector assembly formed in accordance with an alternative embodiment of the present invention.
Figure 8:
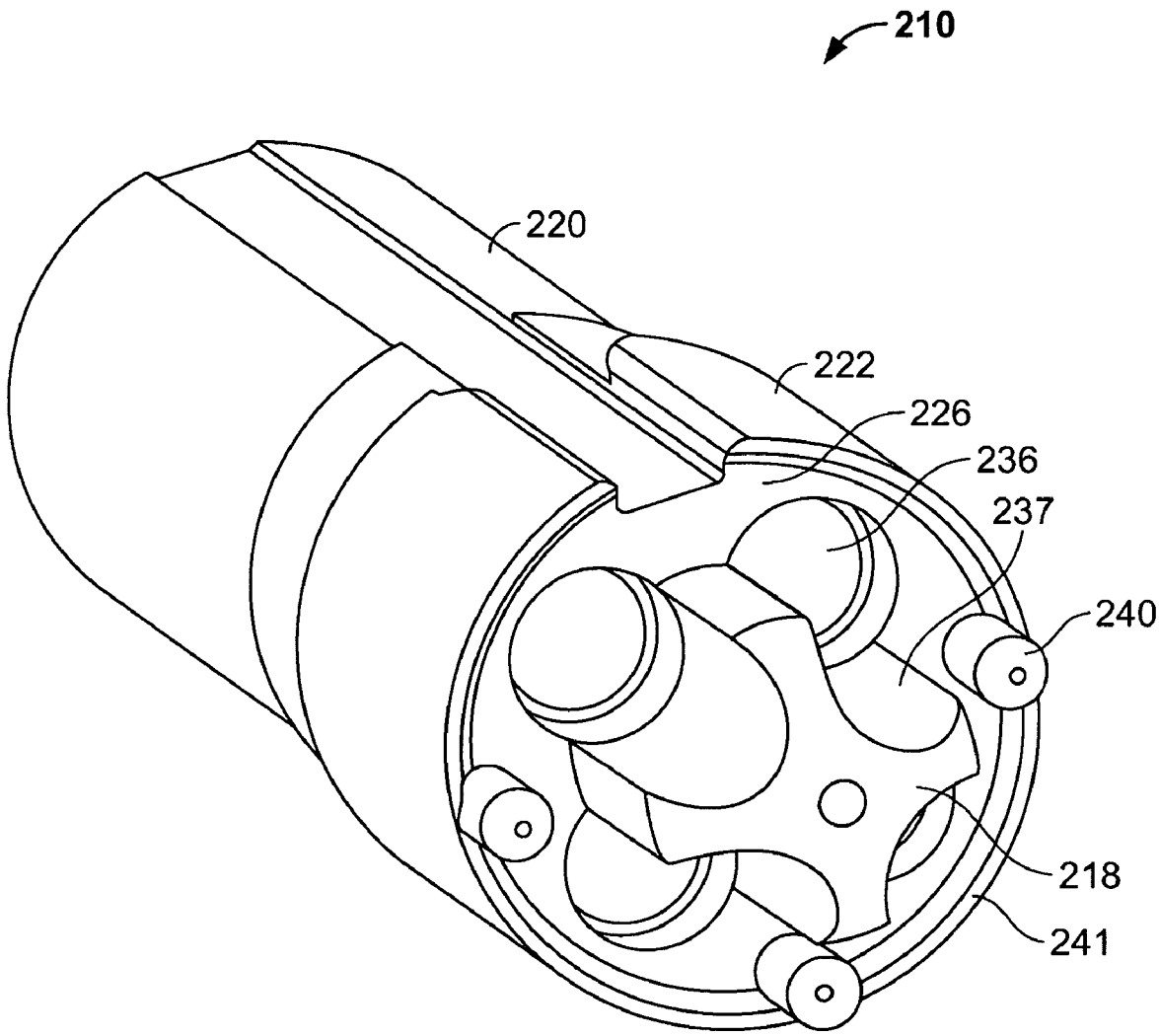
FIG. 8 illustrates a rear end isometric view of a front dielectric member of the socket connector assembly shown in FIG. 7.
Figure 9:
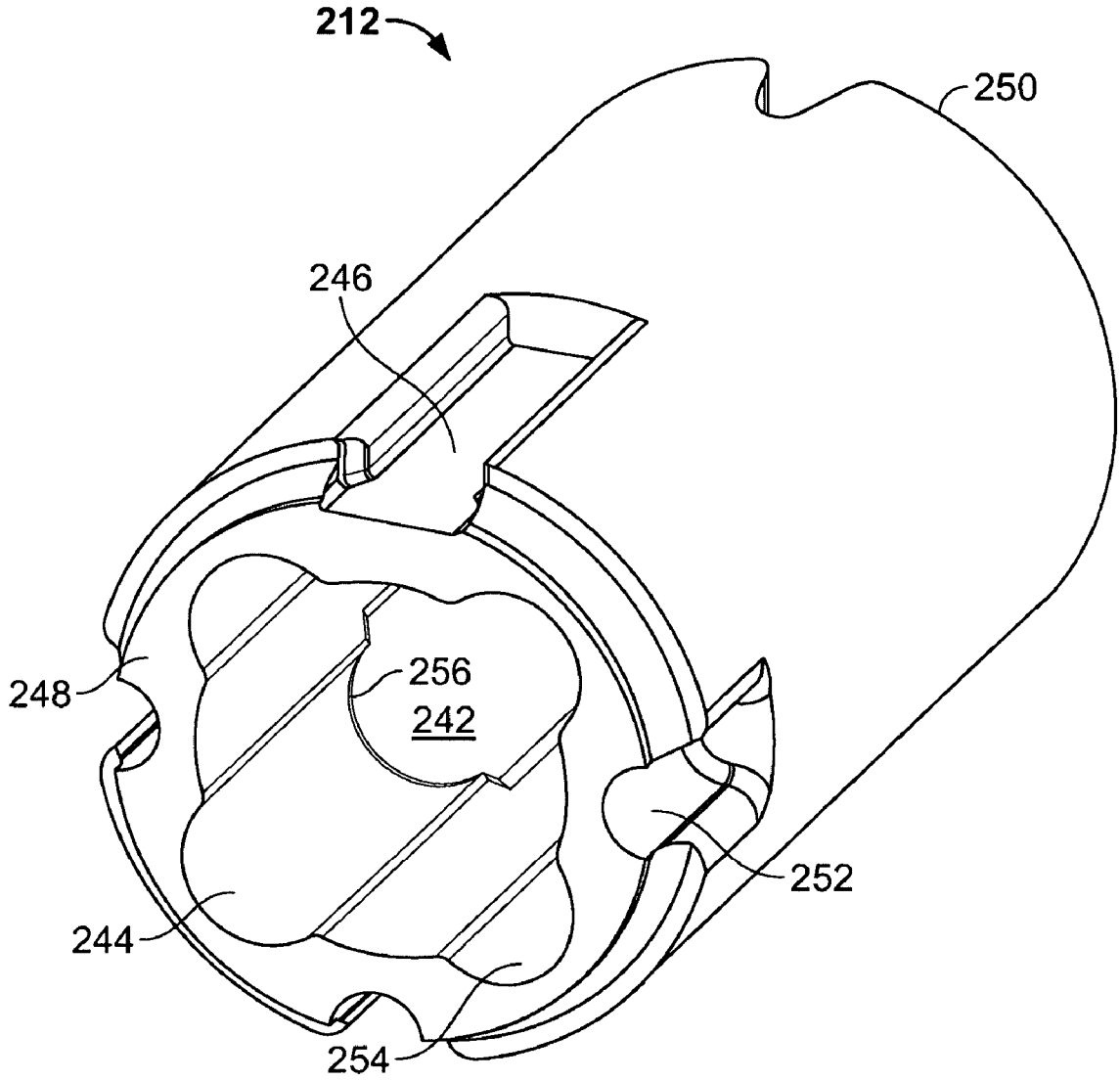
FIG. 9 illustrates a front end isometric view of a rear dielectric member of the pin connector assembly shown in FIG. 7.
Figure 10:
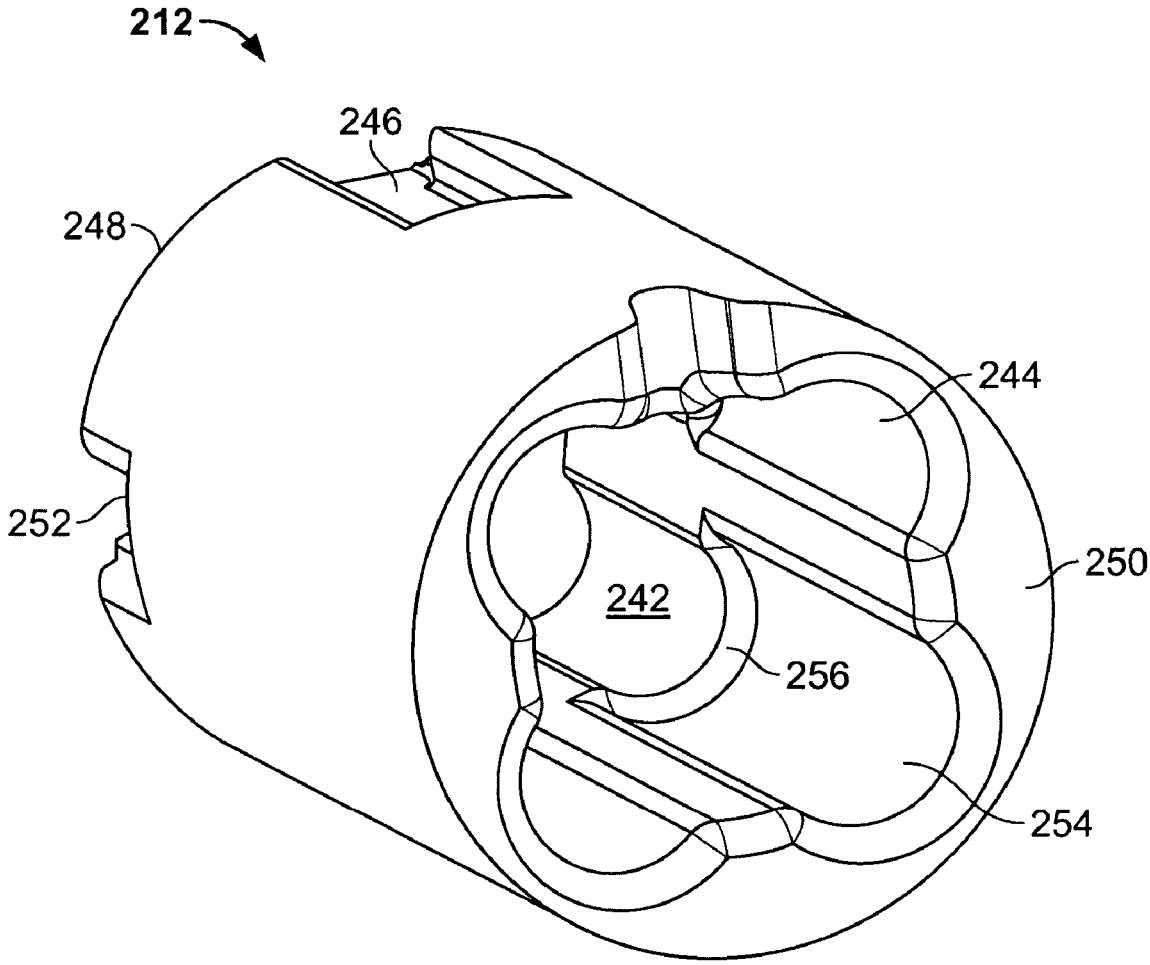
FIG. 10 illustrates a rear end isometric view of the rear dielectric member shown in FIG. 9.

FIG. 7 illustrates an exploded isometric view of a socket connector assembly 200 formed in accordance with an alternative embodiment of the present invention. FIG. 8 illustrates a rear end isometric view of a front dielectric member 210. FIGS. 9 and 10 illustrate front and rear end isometric views, respectively, of a rear dielectric member 212. The socket connector assembly 200 includes similar components to the connector assembly 10 illustrated in FIGS. 1–6 and described in detail above. As such, like reference numerals are numbered the same as those described and shown with respect to FIGS. 1–6 .

As illustrated in FIG. 7, the socket connector assembly 200 includes the outer shell 12, the front dielectric member 210, and the rear dielectric member 212. A plurality of contacts 214 are mounted to signal wires 216 and inserted into the dielectric members 210 and 212. In the illustrated embodiment, the contacts 214 are socket contacts. However, in other embodiments, such as the embodiment illustrated in FIG. 11, the contacts 214 may be pin contacts, similar to the contacts 20 illustrated in FIGS. 1–6 . Additionally, other types of mating contacts 214 may be used with the socket connector assembly 200 as would be appreciated by one skilled in the relevant art.

The front dielectric member 210 is similar in structure and function to the front dielectric member 14 illustrated in FIGS. 1–6 , but includes, among other features, an appendage or locating extension 218 for orienting the contacts 214 within the member 210. The front dielectric member 210 is sized to be positioned within the outer shell 12. Similarly to the front dielectric member 14, and as illustrated in FIG. 8, the front dielectric member 210 includes a base portion 220 and may include an insulating sleeve 222. Optionally, the base portion 220 may be formed integrally with the appendage 218 and/or the sleeve 222. The base portion 220 extends between front and rear ends 224 and 226, the appendage 218 extends between front and rear ends 228 and 230, and the insulating sleeve extends between front and rear ends 232 and 234. In an exemplary embodiment, the appendage 218 extends from the rear end 226 of the base portion 220 such that the rear end 230 of the appendage 218 is positioned rearward of the base portion 220. Additionally, the rear end 234 of the insulating sleeve 222 is positioned rearward of the base portion 220.

A plurality of contact passages 236 are formed within and are defined by the base portion 220 and the appendage 218 of the front dielectric member 210. The portion of the contact passages 236 extending through the base portion 220 are entirely surrounded by the dielectric material of the base portion 220. However, the portion of the contact passages 236 extending along the appendage 218 have an open side along the radially outer portion thereof, and thus are only partially surrounded by the dielectric material. The appendage 218 is designed as such for ease of manufacture and to reduce the overall size and weight of the socket connector assembly 200. Optionally, the portion of the contact passages 236 extending along the appendage 218 may be completely surrounded by the appendage 218 or another dielectric material. Additionally, the contact passages 236 are axially oriented with respect to the dielectric member 210 and are formed in a predefined geometry relative to the dielectric member 210.

Moreover, FIG. 8 illustrates an exemplary orientation of the appendage 218 and the contact passages 236, however, other configurations may be employed within the scope of the invention. In the illustrated embodiment, the appendage 218 extends from the rear end 226 of the base portion 220. The rear end 226 functions as a shoulder or locator for positioning the contacts 214 with respect to the front dielectric member 210. Optionally, during assembly, each contact 214 is loaded into the contact passages 236 until a raised surface defining an annular ring around the contact 214 having a front facing shoulder engages the rear end 226 of the base portion 220. The appendage 218 functions as an insulated interior wall for supporting the contacts 214 when the connector assembly 200 is assembled. The appendage 218 also functions as a locator for the contacts 214. A plurality of radiused surfaces 237 extend into the appendage 218 to define the contact passages 236. The radiused surfaces 237 are spaced apart from one another such that dielectric material is positioned between each of the contact passages 236. Additionally, the radiused surfaces 237 are oriented such that each contact passage 236 includes an open side. Optionally, the open side of each contact passage 236 is positioned at the radially outer portion of the contact passage 236.

A keying notch 238 is formed along an exterior surface of the base portion 220 and the sleeve 222. The keying notch 238 extends rearward from the front ends 224 and 232, and may optionally include chamfered edges at the front ends 224 and 232. The keying notch 238 is shaped and positioned to interface with the lug 66 projecting into the cavity 58 of the outer shell 12.

Optionally, the front dielectric member 210 may include a keying feature 240 for mating and properly aligning the front dielectric member 210 with the rear dielectric member 212. In one embodiment, as described in more detail below with respect to FIG. 8, the keying feature 240 is a pin or finger extending from the rear end 226 of the base portion 220. Optionally, the front dielectric member 210 may include multiple keying features 240. The keying features 240 may be oriented such that the dielectric members 210 and 212 may be mated in a single manner.

The outer perimeter of the rear end 226 of the base portion 220 is surrounded by the insulating sleeve 222. The sleeve 222 is oriented to surround at least a portion of the rear dielectric member 212 (shown in FIG. 7). Optionally, an outer portion 241 of the sleeve 222 is chamfered, and the chamfered portion engages with a similarly chamfered portion of the rear dielectric member 212. Additionally, the keying features 240 are positioned around the outer perimeter of the rear end 226 of the base portion 220. Optionally, the keying features 240 may be positioned a distance away from the appendage 218.

The rear dielectric member 212 is similar in structure and function to the rear dielectric member 16 illustrated in FIGS. 1–6 . However, in contrast to the rear dielectric member 16, the rear dielectric member 212 does not include an extension, such as the lead section 106 illustrated in FIG. 1. Rather, and as illustrated in FIGS. 9 and 10, the rear dielectric member 212 includes a cavity or bore 242 defining a hollow interior of the rear dielectric member 212. As a result, the contacts 214 may be more easily inserted or loaded into the rear dielectric member 212 during assembly of the socket connector assembly 200. Additionally, the contacts 214 are entirely laterally surrounded by the rear dielectric member 212 to provide additional insulation between the contacts 214 and the outer shell 12 when the socket connector assembly 200 is assembled. As a result, the rear dielectric member 212 defines a cover for the contacts 214 with respect to the outer shell 12 and provides better signal integrity as compared to connectors that do not provide an insulative or dielectric layer between the contacts 214 and the outer shell 12.

Similarly to the rear dielectric member 16, the rear dielectric member 212 includes a plurality of open sided contact passages 244 formed within and defined by the rear dielectric member 212. In an exemplary embodiment, the walls of the contact passages 244 are defined by the radially inner surface of the rear dielectric member 212, and the contact passages 244 are open to the cavity 242. The rear dielectric member 212 is designed as such for ease of manufacture and to reduce the overall size and weight of the socket connector assembly 200. Optionally, the contact passages 244 may be completely surrounded by the rear dielectric member 212 or another dielectric material.

Additionally, the rear dielectric member 212 includes a keying notch 246 extending along a portion of the exterior surface thereof from a front end 248 towards a rear end 250 of the rear dielectric member 212. The keying notch 246 may optionally include chamfered edges at the front end 248 of the rear dielectric member 212. The keying notch 246 is shaped and positioned to interface with the lug 66 projecting into the cavity 58 of the outer shell 12. Additionally, when assembled, the keying notch 246 of the rear dielectric member 212 is substantially aligned with the keying notch 238 of the front dielectric member 210.

Optionally, the rear dielectric member 212 may include a keying feature 252 for mating and properly aligning the rear dielectric member 212 with the front dielectric member 210. In one embodiment, the keying feature 252 is a pocket positioned along the front end 248 of the rear dielectric member 212. Optionally, the rear dielectric member 212 may include multiple keying features 252. The keying features 252 may be oriented such that the dielectric members 210 and 212 may be mated in a single manner.

As illustrated in FIG. 9, the keying notch 246 and the keying features 252 extend from the front end 248 of the rear dielectric member 212. Optionally, the keying notch 246 and the keying features 252 have different shapes such that the rear dielectric member 212 can be properly aligned and mated with the front dielectric member 210 (shown in FIG. 8). In one embodiment, the keying notch 246 has a rectangular shape and the keying features 252 have a cylindrical shape. As such, the keying features 240 (shown in FIG. 8) of the front dielectric member 210 may only be mated with the rear dielectric member 212 in one way.

In an exemplary embodiment, each contact passage 244 is defined by a radiused surface 254 of the exterior or surrounding wall of rear dielectric member 212. As such, at least a portion of each contact passage 244 is exposed to the environment within the rear dielectric member 16. More specifically, a portion of each contact passage 244 is exposed to the interior cavity 242 of the rear dielectric member 212. Alternatively, the contact passages 244 may be entirely surrounded by insulating material. The contact passages 244 extend between the front and rear ends 248 and 250 of the rear dielectric member 212. Optionally, each contact passage 244 has a non-uniform diameter such that a lip or ridge 256 is positioned between the front and rear ends 248 and 250. Once assembled, the lips 256 align and/or support a portion of the contacts 214 loaded into the contact passages 244. The portion of the contact passages 244 between the lips 256 and the rear end 250 of the rear dielectric member 212 have an increased diameter to accommodate and provide clearance for the signal wires 22 (shown in FIG. 7).

The cavity 242 is sized to receive the appendage 218 of the front dielectric member 210 and, when assembled, the contact passages 236 and 244 of the appendage 218 and the rear dielectric member 212, respectively, cooperate with one another to orient, align, and/or retain the contacts 214 for mating. Additionally, when assembled, the contact passages 236 and 244 of the appendage 218 and the rear dielectric member 212, respectively, completely surround the contacts 214 to provide insulation for the contacts 214.

During assembly, the contacts 214 are inserted or loaded into the rear dielectric member 212 and may be at least partially seated within the contact passages 244 of the rear dielectric member 212. The rear dielectric member 212 functions as a collar to substantially align the contacts 214 with the contact passages 236 of the front dielectric member 210 and to limit the amount of movement of the contacts 214 during loading with the front dielectric member 210. Once aligned, the contacts 214 are inserted or loaded into the contact passages 236 of the front dielectric member 210. Optionally, the contacts 214 may be initially loaded into the contact passages 236 from the rear end 230 of the appendage 218. Alternatively, the contacts 214 may be initially loaded through the slot defined by the exposed or open side of the contact passage 236. The contacts 214 are then fully loaded into the portion of the contact passages 236 within the base portion 220. When the contacts 214 are fully loaded into the contact passages 236 of the front dielectric member 210, the front and rear dielectric members 210 and 212 engage and interface with one another. Specifically, the appendage 218 is inserted into the cavity 242. As a result, the contacts 214 are positioned and retained within the dielectric members 210 and 212. The dielectric members 210 and 212 are then inserted into the outer shell 12. To insert the dielectric members 14 and 16 into the outer shell 12, the keying notches 238 and 246 are visually aligned with the lug 66 of the outer shell 12, and the dielectric members 210 and 212 are inserted into the loading end 54 of the outer shell 12 as a single unit.

Figure 11:
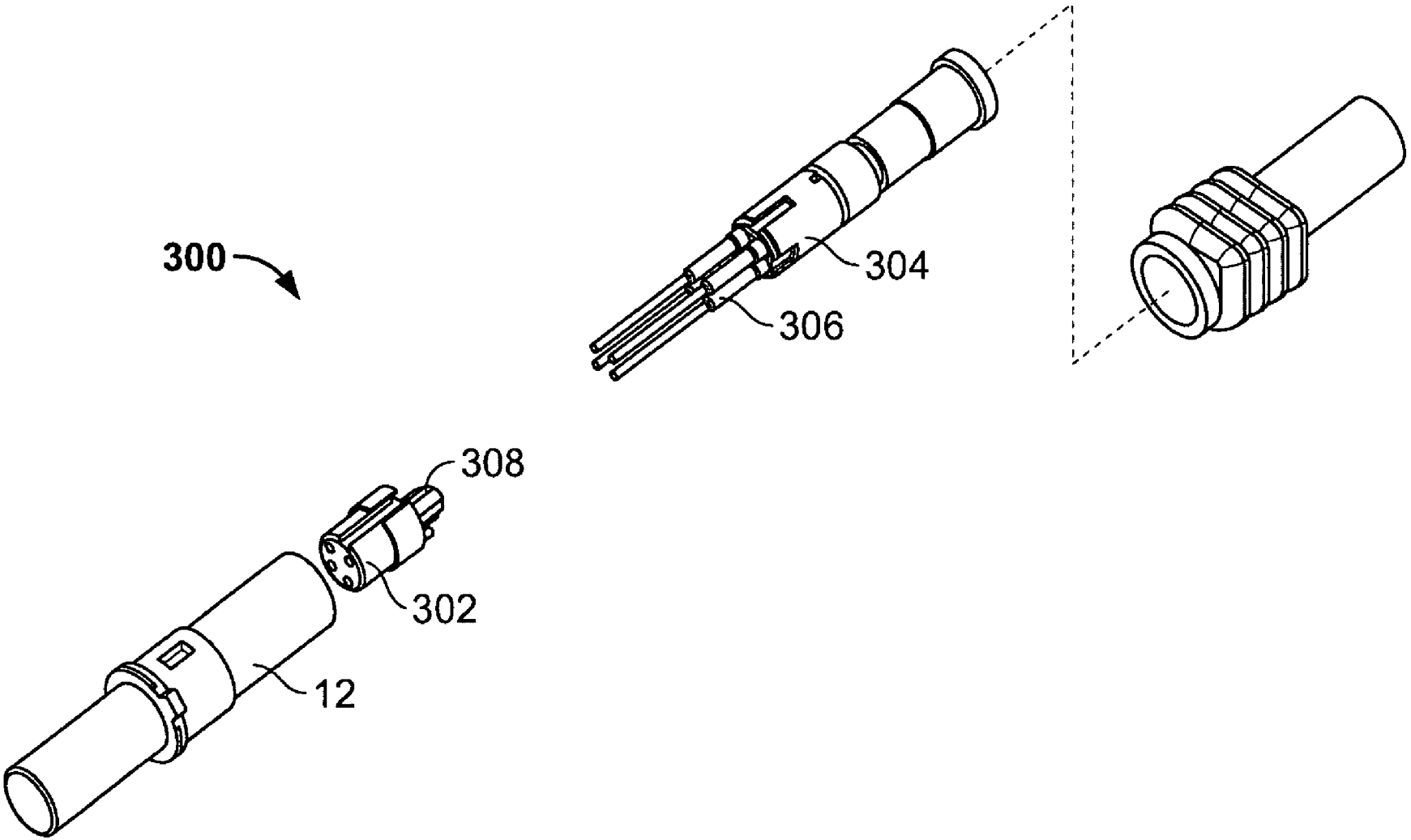
FIG. 11 illustrates an exploded isometric view of a pin connector assembly formed in accordance with another alternative embodiment of the present invention.

FIG. 11 illustrates an exploded isometric view of a pin connector assembly 300 formed in accordance with another alternative embodiment of the present invention. The pin connector assembly 300 is illustrated in a partially assembled state. The pin connector assembly 300 includes similar components to the socket connector assembly 200 illustrated in FIGS. 7–10 and described in detail above. As such, like reference numerals are numbered the same as those described and shown with respect to FIGS. 7–10.

The pin connector assembly 300 includes an outer shell 12, a front dielectric member 302, a rear dielectric member 304, and a plurality of pin contacts 306. Optionally, the pin connector assembly 300, when assembled, is configured to be mated with a mating connector, such as the socket connector assembly 200 illustrated in FIG. 7. More specifically, the pin contacts 306 are mated with and engage the socket contacts 214 of the socket connector assembly 200. Additionally, similar to the socket connector assembly 200, the pin connector assembly 300, and more particularly, the front dielectric member 302, includes an appendage 308.

As illustrated in FIG. 11, the pin connector assembly 300 is partially assembled. Specifically, the contacts 306 are loaded into the rear dielectric member 304 and are positioned for assembly of the front dielectric member 302. During assembly, as the front dielectric member 302 is engaged with the rear dielectric member 304, the appendage 308 is utilized to orient and align the contacts 306 within the pin connector assembly 300.

The above-described embodiments provide a cost effective and reliable means for developing a connector assembly 10, 200, 300. Specifically, the connector assembly 10, 200, 300 includes a plurality of contacts 20, 214, 306 that are configured to be retained and aligned by a pair of dielectric members 14 and 16, 210 and 212, 302 and 304 within an outer shell 12. The dielectric members 14 and 16, 210 and 212, 302 and 304 include contact passages 78 and 104, 236 and 244 that cooperate to completely surround the contacts 20, 214, 306, thus insulating the contacts 20, 214, 306 from the metallic body of the outer shell 12. The dielectric members 14 and 16, 210 and 212, 302 and 304 include keying features that align the dielectric members 14 and 16, 210 and 212, 302 and 304 with each other and with the outer shell 12 during assembly. Accordingly, the assembly time and complexity, and thereby the overall cost, of the connector assembly 10, 200, 300 are reduced.

Exemplary embodiments of a connector assembly 10, 200, 300 are described above in detail. The connector assembly 10, 200, 300 is not limited to the specific embodiments described herein, but rather, components of each connector assembly 10, 200, 300 may be utilized independently and separately from other components described herein. For example, each connector assembly 10, 200, 300 component can also be used in combination with other connector assembly 10, 200, 300 components.

While the invention has been described in terms of various specific embodiments, those skilled in the art will recognize that the invention can be practiced with modification within the spirit and scope of the claims.

What is claimed is:

1. An electrical connector, comprising:

a plurality of contacts, said contacts each having a shoulder;

an outer shell having a cavity formed therein, said cavity extending between a loading end and a mating end of said outer shell, said mating end being configured to join with a mating connector;

a front dielectric member having a base portion and an appendage integrally formed with said base portion and extending from a rear end of said base portion, said base portion and said appendage having contact passages receiving said contacts; and a rear dielectric member having a hollow interior and contact passages extending at least partially between front and rear ends of said rear dielectric member and defining said hollow interior, said contact passages of said rear dielectric member having a non-uniform diameter to define a ridge, said contacts being received in said contact passages of said rear dielectric member such that said shoulders abut said ridges to control a position of said contacts with respect to said rear dielectric member, said front end of said rear dielectric member contacting said rear end of said front dielectric member such that said appendage is positioned within said hollow interior of said rear dielectric member, said contact passages of said appendage and said rear dielectric member cooperating to surround said contacts.

2. The electrical connector of claim 1, wherein said electrical connector defines one of a pin connector and a socket connector, said mating connector comprises the other of the pin connector and the socket connector.

3. The electrical connector of claim 1, wherein said contact passages of said appendage extend along a radially inner surface of said contacts and said contact passages of said rear dielectric member extend along a radially outer surface of said contacts.

4. The electrical connector of claim 1, wherein said contact passages of said appendage are defined by radiused surfaces and said contact passages of said appendage have an open side, and said contact passages of said rear dielectric member are defined by radiused surfaces and said contact passages of said rear dielectric member have an open side, edges of said radiused surfaces of said appendage and said rear dielectric member engaging one another.

5. The electrical connector of claim 1, wherein said front dielectric member further comprises a sleeve extending from said base portion, said front end of said rear dielectric member being inserted at least partially into said insulating sleeve.

6. The electrical connector of claim 1, wherein each of said contacts comprises a ledge and one of said front and rear dielectric members comprises a shoulder, said contacts are received in said front and rear dielectric members until said ledge engages said shoulder.

7. The electrical connector of claim 1, wherein each of said front and rear dielectric members comprises a chamfered abutment surface, said abutment surfaces of each of said front and rear dielectric members overlap one another.

8. The electrical connector of claim 1, wherein said outer shell comprises a keying feature and at least one of said front and rear dielectric members comprises a keying feature, said keying features of said outer shell engaging said keying feature of said at least one of said front and rear dielectric members for aligning said dielectric members within said outer shell.

9. The electrical connector of claim 1, wherein each of said front and rear dielectric members comprises a keying feature, said keying features of each of said front and rear dielectric members engage one another for aligning said dielectric members with one another.

10. The electrical connector of claim 8, wherein said keying feature of said front dielectric member comprises a pin, said keying feature of said rear dielectric member comprises a pocket, said pin received within said pocket.

11. An electrical connector assembly, comprising:

a cable with contacts secured to cable connectors;

an outer shell with a cavity therein, said cavity extending through said shell;

a front dielectric member having a base portion and an appendage extending from a rear end of said base portion, said base portion and said appendage having contact passages configured to receive contacts, said contact passages of said appendage configured to receive said contacts such that at least a portion of said contacts are exposed laterally through open sides of said contact passages; and a rear dielectric member having discrete contact passages formed therein that extend at least partially between front and rear ends of said rear dielectric member, said contacts abut said contact passages of said rear dielectric member when receieved therein, said contact passages of said rear dielectric member configured to receive said contacts such that at least a portion of said contacts are exposed laterally through open sides of said contact passages, said appendage is positioned within said rear dielectric member such that said contact passages of said appendage and said rear dielectric member cooperate to surround said contacts.

12. The electrical connector assembly of claim 11, wherein said contact passages of said appendage and said rear dielectric member are defined by radiused surfaces, edges of said radiused surfaces of said appendage and said rear dielectric member engaging one another.

13. The electrical connector assembly of claim 11, wherein said front dielectric member further comprises a sleeve extending from said base portion, said front end of said rear dielectric member being inserted at least partially into said insulating sleeve.

14. The electrical connector assembly of claim 11, wherein each of said contacts comprises a ledge and one of said front and rear dielectric members comprises a shoulder, said contacts are received in said front and rear dielectric members until said ledge engages said shoulder.

15. The electrical connector assembly of claim 11, wherein each of said front and rear dielectric members comprises a chamfered abutment surface, said abutment surfaces of each of said front and rear dielectric members overlap one another.

16. The electrical connector assembly of claim 11, wherein said outer shell comprises a keying feature and at least one of said front and rear dielectric members comprises a keying feature, said keying features of said outer shell engaging said keying feature of said at least one of said front and rear dielectric members for aligning said dielectric members within said outer shell.

17. The electrical connector assembly of claim 11, wherein said electrical connector assembly defines one of a pin connector assembly and a socket connector assembly.

18. The electrical connector assembly of claim 11, wherein said contact passages of said appendage extend along a radially inner surface of said contacts and said contact passages of said rear dielectric member extend along a radially outer surface of said contacts.

19. The electrical connector assembly of claim 11, wherein each of said front and rear dielectric members comprises a keying feature, said keying features of each of said front and rear dielectric members engage one another for aligning said dielectric members with one another.

20. The electrical connector assembly of claim 19, wherein said keying feature of said front dielectric member comprises a pin, said keying feature of said rear dielectric member comprises a pocket, said pin received within said pocket.

* * * * *